US005603434A

United States Patent [19]

von Schuckmann

[11] Patent Number: 5,603,434

[45] Date of Patent: Feb. 18, 1997

[54] TRIGGER SPRAYER

[75] Inventor: Alfred von Schuckmann, Kevelaer, Germany

[73] Assignee: Owens-Illinois Closure Inc., Toledo, Ohio

[21] Appl. No.: 352,146

[22] Filed: Dec. 1, 1994

[30] Foreign Application Priority Data

Dec. 11, 1993 [DE] Germany ..... 43 42 304.3

[51] Int. Cl.[6] ..... B67D 5/32

[52] U.S. Cl. ..... 222/153.14; 222/207; 222/209; 222/383.1; 222/481.5

[58] Field of Search ..... 222/153.13, 153.14, 222/207, 209, 321.7, 383.1, 481.5

[56] References Cited

U.S. PATENT DOCUMENTS

| | | | |
|---|---|---|---|
| D. 256,271 | 8/1980 | Tada | D23/17 |
| 3,726,442 | 4/1973 | Davidson et al. | 222/207 |
| 3,897,006 | 7/1975 | Tada | 239/333 |
| 3,973,700 | 8/1976 | Schmidt et al. | 222/153 |
| 3,986,644 | 10/1976 | Grogan et al. | 222/207 |
| 4,101,057 | 7/1978 | LoMaglio | 222/207 |
| 4,138,038 | 2/1979 | Grogan | 222/207 |
| 4,155,487 | 5/1979 | Blake | 222/207 |
| 4,204,614 | 5/1980 | Reeve | 222/153 |
| 4,230,277 | 10/1980 | Tada | 239/333 |
| 4,958,754 | 9/1990 | Dennis | 222/383 |
| 5,158,233 | 10/1992 | Foster et al. | 239/333 |
| 5,294,025 | 3/1994 | Foster | 222/383 |
| 5,303,867 | 4/1994 | Peterson | 222/383.1 |

FOREIGN PATENT DOCUMENTS

| | | |
|---|---|---|
| 2461530 | 10/1976 | France . |
| 9317956 | 12/1992 | WIPO . |

*Primary Examiner*—Joseph Kaufman

[57] ABSTRACT

A trigger sprayer has a housing with an integral front component including an orifice plate to which is hinged by "living" hinges a sealing door for the orifice and a trigger lever. It includes an integral fastener on the plate for securing it to the housing. In one embodiment a vent passage is closed off by the same sealing door. In other embodiments the vent is operated by a leg integral with the trigger lever.

20 Claims, 13 Drawing Sheets

TRIGGER SPRAYER

BACKGROUND OF THE INVENTION

1. Field of the Invention

This invention relates to trigger sprayers of the type which are mounted on the top of a container. Such sprayers comprise a trigger-operated pump which pumps liquid, such as a cleaner, up through a dip tube out of the container to discharge through an appropriate orifice. More specifically, this invention relates to a trigger sprayer in which the pump is a bellows worked by the trigger. The invention further relates to vent means for permitting air to pass from the outside into the container to take the place of the removed liquid and equalize internal air pressure with the outside.

2. Description of Related Art including Information Disclosed under §§1.97 to 1.99

The prior art includes a large number of trigger sprayers in which the pump means is a bellows. A number of these references provide hinged triggers, each having a leg which engages and works a bellows pump when the trigger is pulled. Examples are the U.S. Pat. No. 3,986,644 which issued Oct. 19, 1976 to Grogan et al; U.S. Pat. No. 4,138,038 which issued Feb. 6, 1979 to Grogan; U.S. Pat. No. 4,155,487 which issued May 22, 1979 to Blake; and U.S. Pat. No. 4,204,614 which issued May 27, 1980 to Reeve.

The need for appropriate venting means to permit the passage of air from the outside to the inside of the container is also the subject of patents, a number of which are in the name of Tetsua Tada. In Tada U.S. Pat. No. 3,897,006, for instance, a probe moves toward the container as the trigger is pulled and pokes open a rubber sealing sleeve in a section of the sprayer housing. Other showings of venting include Smith et al U.S. Pat. No. 3,973,700 wherein a vent passage extends from the container up into the sprayer housing and ends in an opening to the atmosphere. The opening is closed off when the trigger is in retracted position.

Prior art includes showing of triggers which are hinged to a housing by means of a "living" hinge. See, for instance, U.S. Pat. No. 4,199,083 which issued Apr. 22, 1980 to LoMaglio. Also in the past, doors for sealing the sprayer orifice have hinged to the front of the sprayer housing as shown in the Tada U.S. Pat. No. 4,230,277.

SUMMARY OF THE INVENTION

The present invention contemplates an effective economical trigger sprayer having a minimum number of parts and a large number of desirable features. In the various embodiments of the invention disclosed herein the trigger sprayer housing encloses a bellows pump for pumping liquid up from the container on which it is mounted and out a suitable discharge orifice at the front of the housing. To the discharge end or front of the housing is secured a front component including an orifice plate to which is hinged by "living" hinges, a sealing door for the orifice and a trigger lever and leg for working the bellows and opening a vent passage. The front component is integrally formed of molded plastic to give a simple single piece including appropriately aligned elements. It includes integral fasteners for securing it to the housing.

The invention also contemplates a vent passage which is closed off by the same sealing door and another vent arrangement operated by a leg integral with a trigger lever.

One embodiment of the invention is a housing structured to be mounted on the container and give the assembly a usually low profile.

BRIEF DESCRIPTION OF THE DRAWINGS

Other objects and features of the invention will be apparent from a review of the following specification and the accompanying drawings all of which disclose non-limiting embodiments of the invention. In the drawings.

DESCRIPTION OF THE PREFERRED EMBODIMENT

Figure 1:
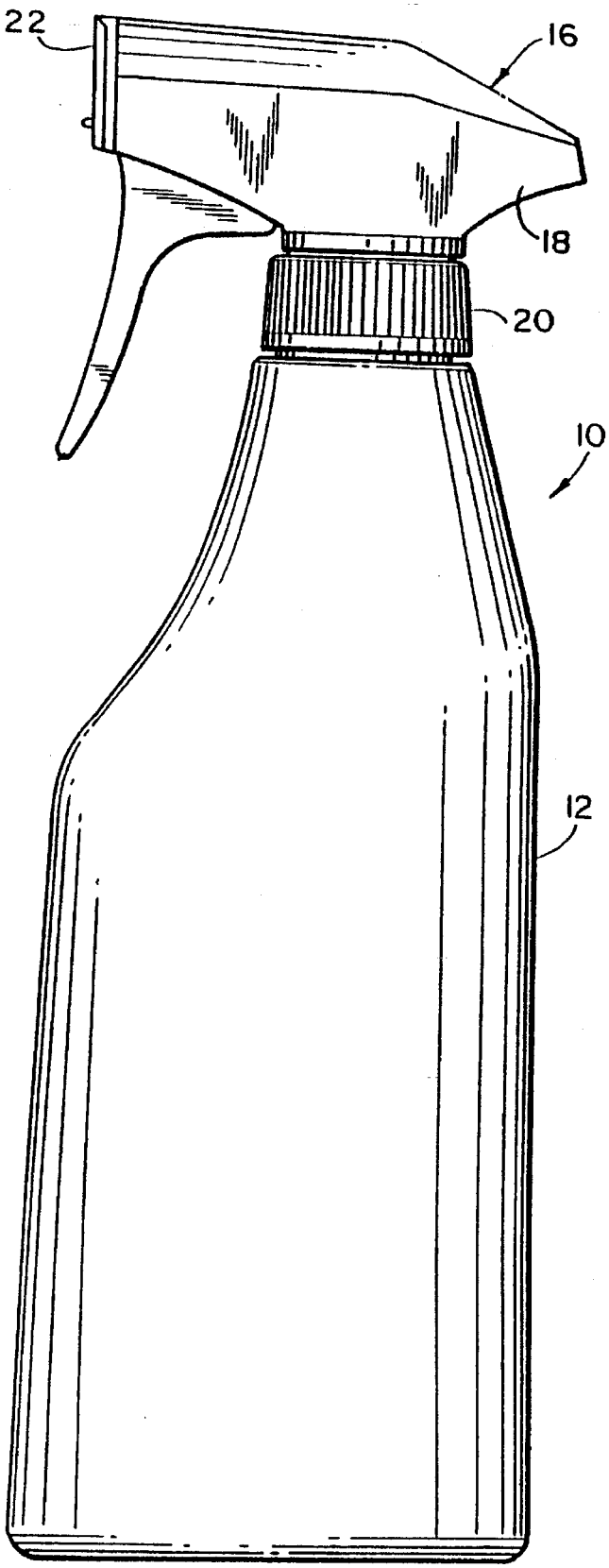
FIG. 1 is an elevational view of a trigger sprayer embodying the invention mounted on a container.
Figure 2A:
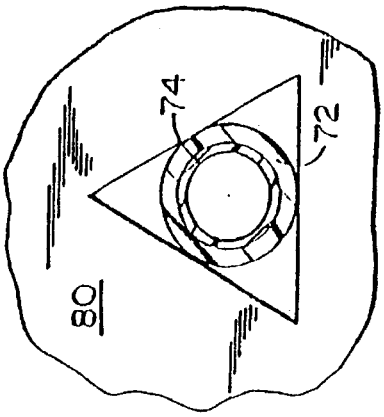
FIG. 2*a* is a fragmentary sectional view of a modified gasket and lower part.
Figure 2:
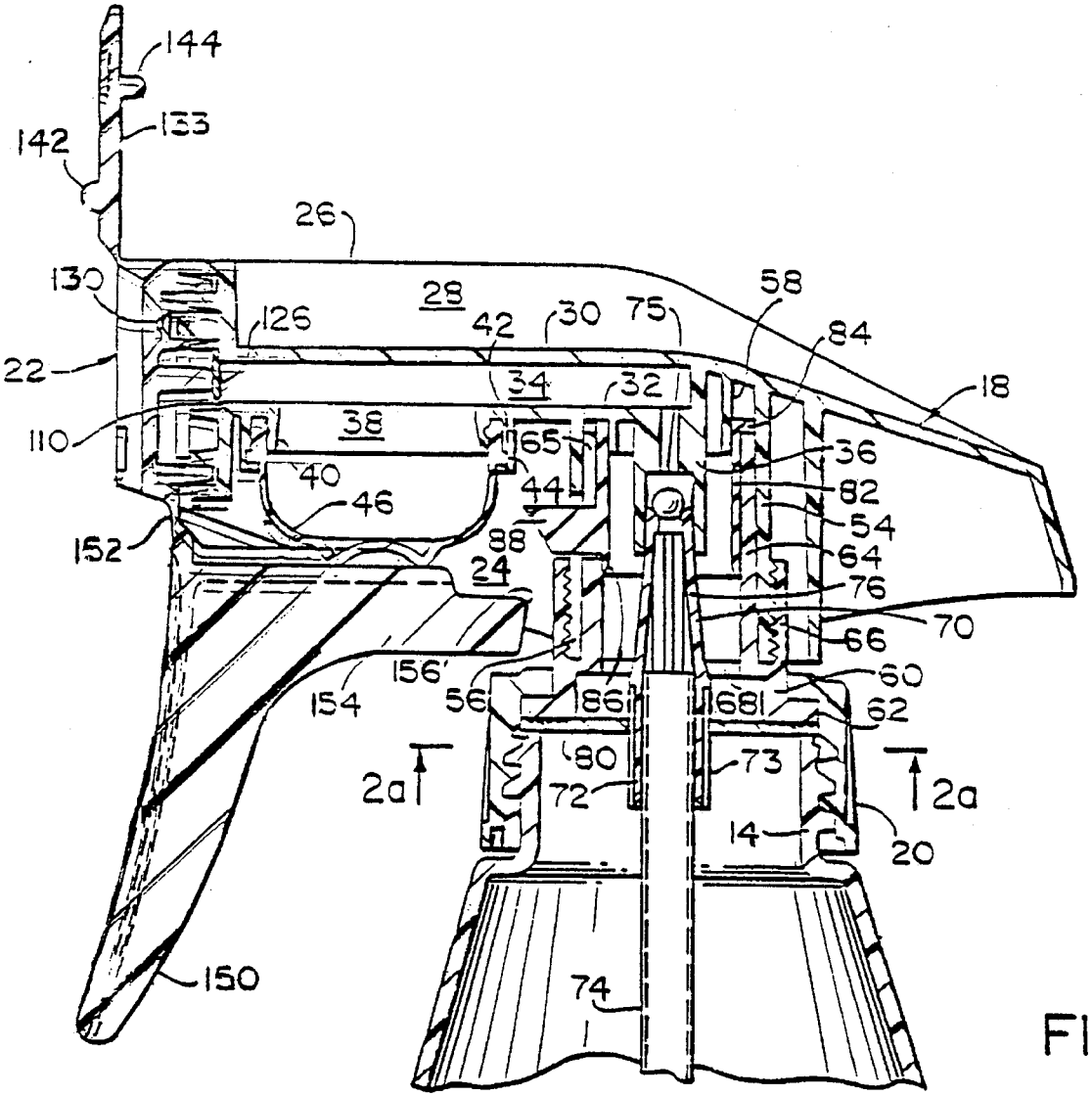
FIG. 2 is an enlarged fragmentary sectional view cut through the center line of the housing and container.

A complete dispenser embodying the invention is shown in FIG. 1 and generally designated 10. It comprises a container 12 having a threaded finish 14 (FIG. 2). Usually the container will be blow-molded polyethylene. Other container shapes are, of course, envisioned.

Screwed onto the container is the trigger sprayer assembly 16 which comprises a housing 18 and a screw cap 20 adapted to engage the threaded finish 14. A front end component 22 is secured to the front or discharge end of the housing.

The housing 18 is a plastic molded piece comprising side walls 24, only one of which is shown in the sectional view (FIG. 2). Joining the side walls is a top wall 26 having a longitudinal recess 28 having a floor 30 spaced below which is an intermediate wall 32 running to the side walls 24, the walls 30 and 32 defining a horizontal passage 34 to the rear end of which is joined a perpendicular downward vertical product tube 36. The opening in the lower end of tube 36 is enlarged to present a downward annular shoulder which may be grooved to permit passage of product through the tube even when the ball 75 (to be described) is up. The intermediate wall 32 is formed intermediate the tube 36 and the discharge end of the housing with a large downward opening 38 communicating with passage 34. Surrounding the opening is a downward rim 40 and outside it is an annular wall 42 having a reduced lower end presenting thereinside a downward shoulder 44.

A resilient bowl-shaped bellows 46 (FIG. 7) is provided and has an inward enlargement 48 around its mouth. The rim 40 is deformed outward to clamp the enlargement 48 in position. An outward rib 50 on the bellows fits against the shoulder 44 and the lower end of wall 42 is staked in at 52 to secure the bellows.

Integral with the housing and rearward of the bellows 46 is the downward annular support wall 54 (FIG. 2) serrated at its lower end. It concentrically circumposes the vertical tube 36. The wall 54 is formed with a longitudinal slot 56 from its lower end facing the front of the housing. Inward of the wall 54 is a short concentric annular seal stabilizing wall 58.

A tubular support 60 or retainer is provided. It terminates downwardly in an outward flange 62. The top wall of the cap 20 is apertured to encircle the lower end of the tubular support 60. The flange 62 in assembly with the container 12 is clamped by the partial top wall of the cap 20 against the top of the finish 14.

The tubular support 60 or retainer has a primary tubular upward wall 64 concentric but of reduced diameter with respect to flange 62. Wall 64 telescopes inside the downward annular support wall 54 of the housing and has a longitudinal slot 65 from its upper end toward the front of the housing. Slot 65 aligns with the slot 56 in the wall 54. An outer concentric wall 66 is internally serrated, and in assembly the downward wall 54 slides inside the wall 66 and 54 and is held there by the serrations.

The tubular support also has radial inward ribs 68 which extend across to support a tubular coupling 70, the lower part 72 of which receives the customary dip tube 74, and the upper part 76 narrows and is received into the enlarged lower end of the product tube 36 of the housing. The enlargement of the tube 36 provides an operating chamber for a check ball 75 which normally seats on the top of the upper part 76 to prevent backflow of product.

The ribs 68 permit between them axial passage of vent air. Externally the lower part 72 is longitudinally slotted as at 73 and there is provided a sealing gasket 80 the perimeter of which is sandwiched between the flange 62 and the top of the finish. The central opening in the gasket closely hugs the lower part 72. Vent air, when the assembly is vented, can pass between the ribs 68 and through the slots between the lower part 72 and the gasket 80.

Alternatively the ribs 68 are replaced by a wall (not shown) radially across the structure. The wall may have a single aperture preferably at a position remote from the trigger 150 so that when the sprayer is tipped forward, product will not find its way easily to the aperture and leak out during venting. FIG. 2*a* shows a modified lower part 72 and gasket 80 in which the hole in the gasket may be triangular or other shape to permit venting without permitting liquid product to easily find its way out.

Figure 6:
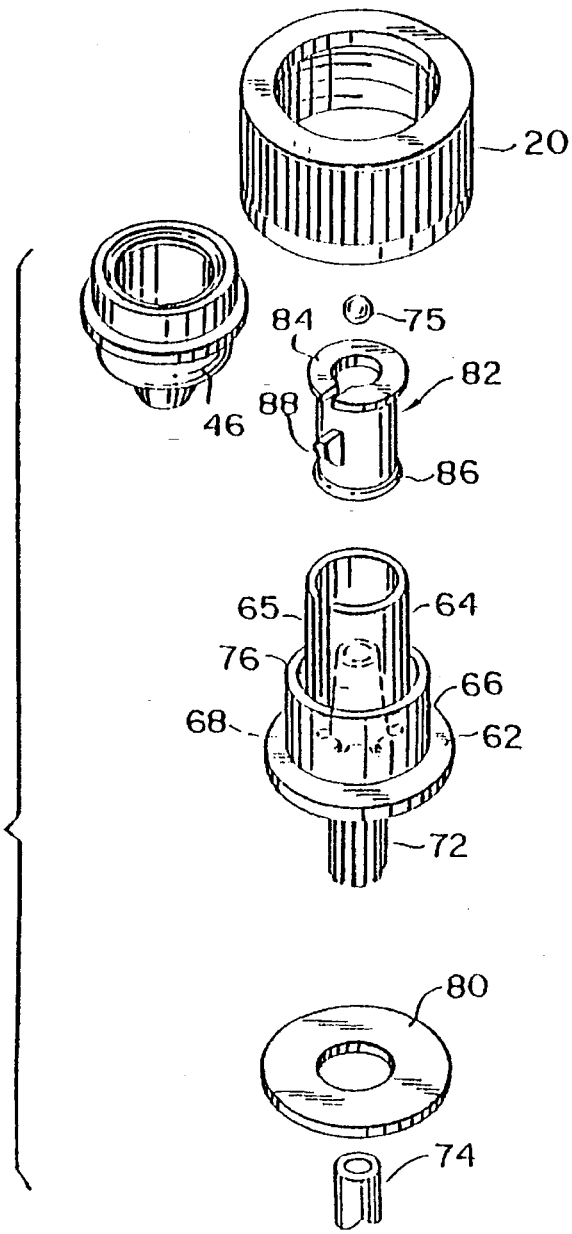
FIG. 6 is an exploded view showing various parts of the sprayer including some of the parts which attach the housing to a container, and the bellows.

A vent seal 82 is provided and formed with an outward peripheral outward flange 84 at its upper end (FIG. 6). The seal, which may be made of a resilient elastic material, has a tubular body with an outward lip 86 at its lower end adapted to engage about the inside of the wall 64 below the slot 65. The seal is also formed with a laterally outward nose 88 which has a beveled-off end so that its upper end extends out from the body of the seal farther than the upper end.

In assembly the vent seal 82 is inserted into the wall 64 (FIG. 2) and receives stabilizing wall 58. In further assembly as described already, the wall 54 is brought down over the wall 64. Serrations as shown help hold the parts together. The slots 56 and 65 in walls 54 and 64 are aligned and provide ample passage of the radial nose 88. Nose 88 extends out beyond the wall of the boss 50 as shown in FIG. 2. The intermediate wall 32 clamps the seal flange 84 against the top of the wall 64.

The housing is formed with a front discharge end wall 104. The wall 104 (FIG. 3, FIG. 4) is formed with a flat vertical front face, and an annular groove or socket 106 is formed about the opening 108 where the passage 34 emerges in the face. The opening 108 is enlarged at the front end to present an annular shoulder 110. Above the enlargement there is formed a circular V-shaped groove 112 which defines a round stud 114 in the front wall 104 inside the annular socket 106.

The annular groove 106 is undercut (FIG. 7) for the purpose of securing to the discharge end the front end component 22. Component 22 comprises the orifice plate 120 formed with an integral ring 122 on its rear face. The ring slopes slightly toward its axis and into the groove 106. Within the ring the rear face of the plate 120 is formed with a rearward stud 124 aligned with the opening 108.

Figure 5:
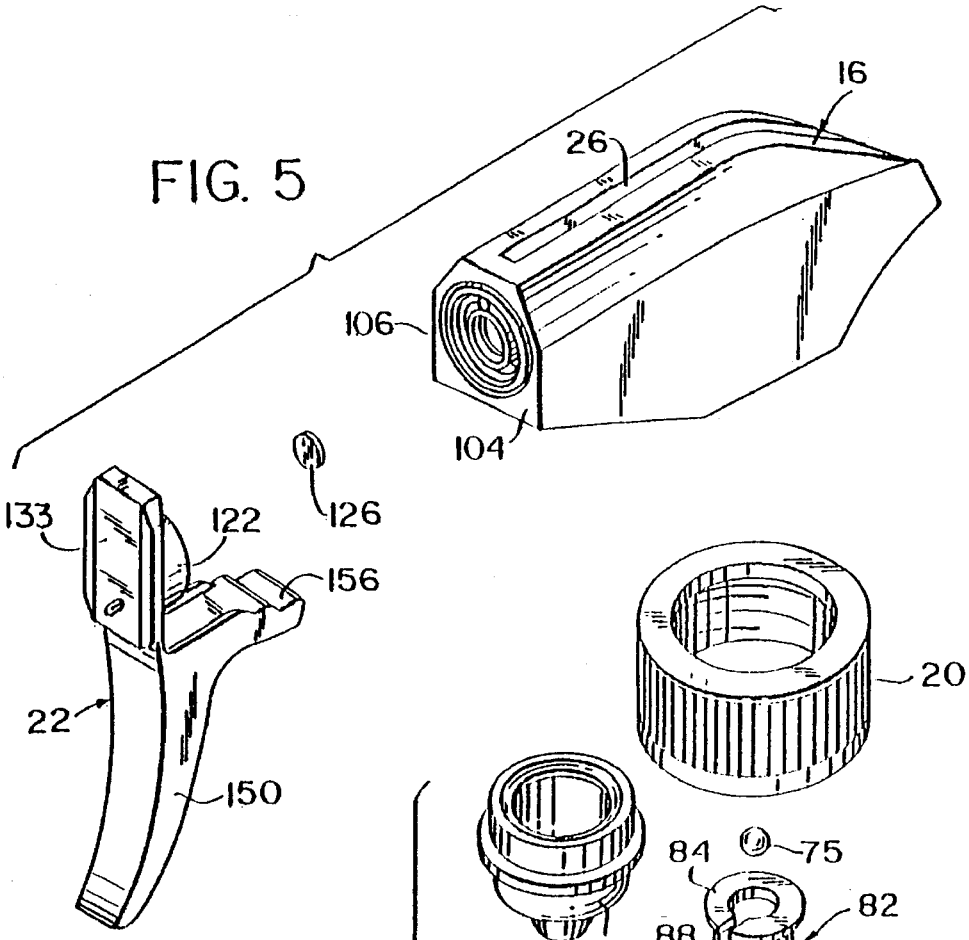
FIG. 5 is an exploded perspective view showing the front component and the housing.

In assembly a resilient valve disc 126 (FIGS. 5,7) is disposed against the shoulder 110. The front end component 22 is maneuvered so that ring 122 is inserted into the annular groove 106. When the rim of the ring 122 snaps into the undercut in the annular groove 106, and the plate 120 is thereby held tight against the flat front end 104 of the housing. The stud 124 sandwiches the disc 126 between it and the shoulder 110 to form a check valve limiting flow of liquid backward through the tube 34.

Figure 7:
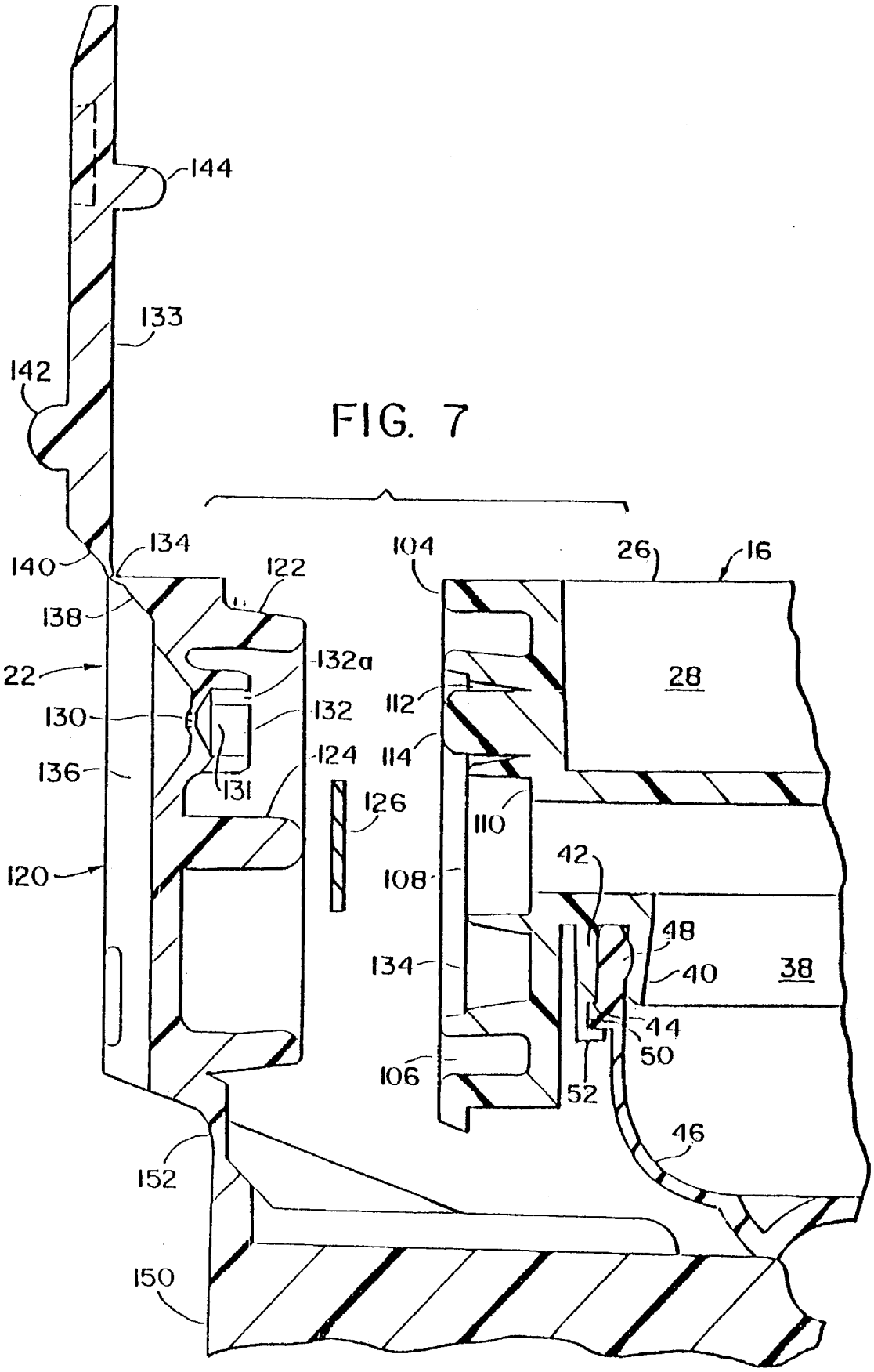
FIG. 7 is a greatly enlarged exploded fragmentary section of the front of the housing showing the front end parts prior to assembly.

The plate 120 is additionally formed with an hour-glass-shaped orifice 130 (FIG. 7) and the plate is provided with a rearward cup-shaped wall 132 which, in assembly, fits about the stud 114 with its walls received into and plugging the annular V-shaped groove. When the plate 120 is in place, the wall 132 and the conical rear surface adjacent orifice 130 forms a swirl chamber 131 for discharging product. Entrance to the chamber is through the interruption 132*a* in wall 132 which is accessible to the product because the frontal area of the front 104 inside the socket 106 is set back as at 134 (FIG. 7).

Comprising component 22 the plate 120 has door 133 attached to it by means of an integral "living" hinge 134. As shown, the front of the plate 120 is formed with forwardly projecting sides 136 (only one shown in FIG. 7) to form a door-receiving recess and retainer. The top of the recess is beveled as at 138 and the door is complimentary shaped as at 140. Further, the door is formed with a sealing bump 142 and a hold-open head 144.

Thus, the door 133 has two extreme positions. In one the door 133 may be hinged all the way back against the top wall 26 (FIG. 2) so that the head 144 snaps into recess 28 thereby holding the door in the open position. In the other, the door 133 may be brought down so that it wedges or snaps between the side walls 136 in the door-receiving recess. The sealing bump 142 in this position closes the orifice 130 and seals it.

A third component of the integrally molded front component 22 is, of course, the trigger lever 150 (FIG. 2). The lever is connected to the orifice plate 120 by a second "living" hinge 152. The lever 150 is formed on its rearward side with a rigid unitary leg 154. The leg is formed with an upper surface which engages the bottom of the bellows 46.

Figure 3:
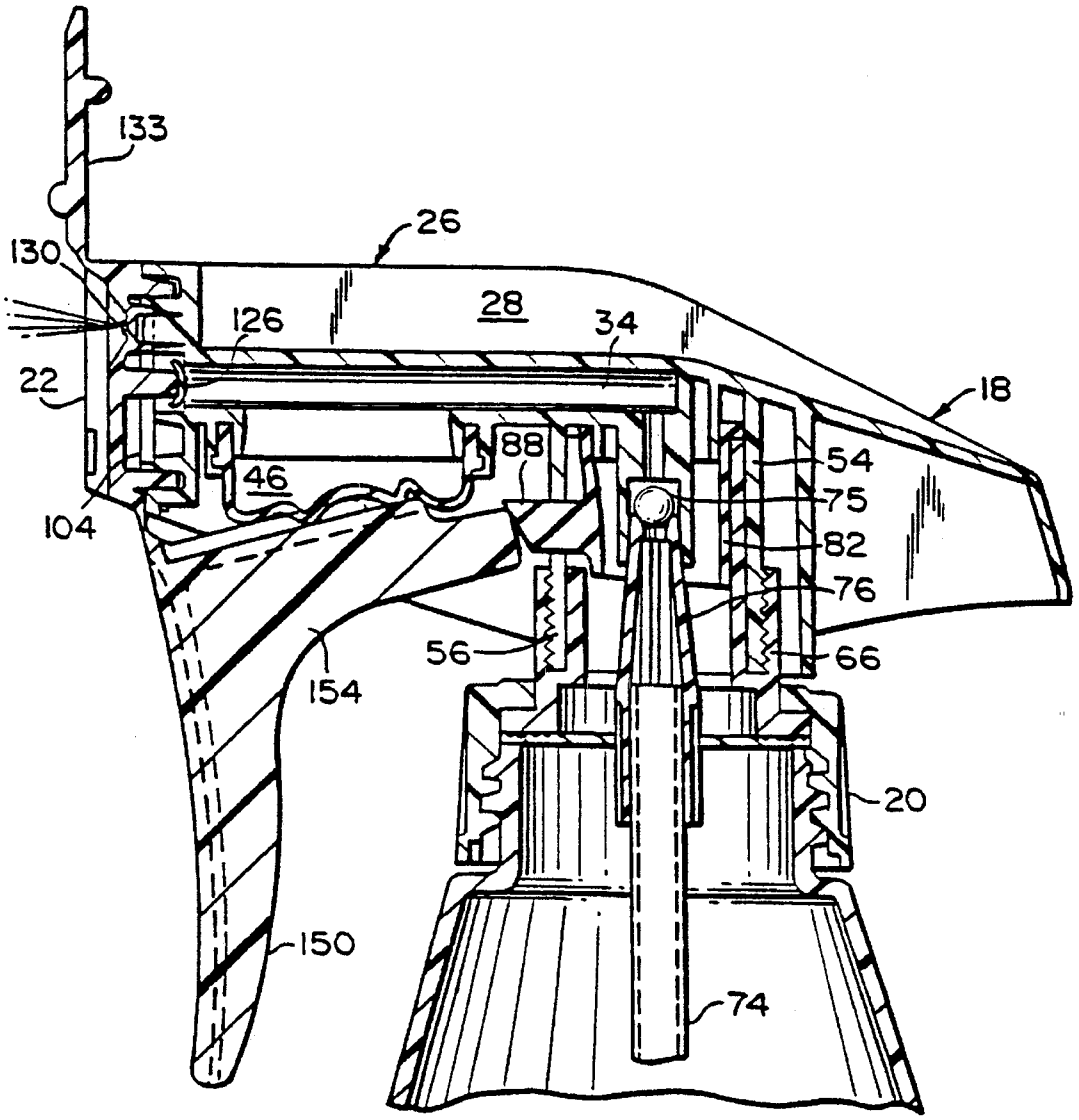
FIG. 3 is a view similar to FIG. 2 but showing the trigger lever being squeezed to work the bellows pump and open the vent.
Figure 4:
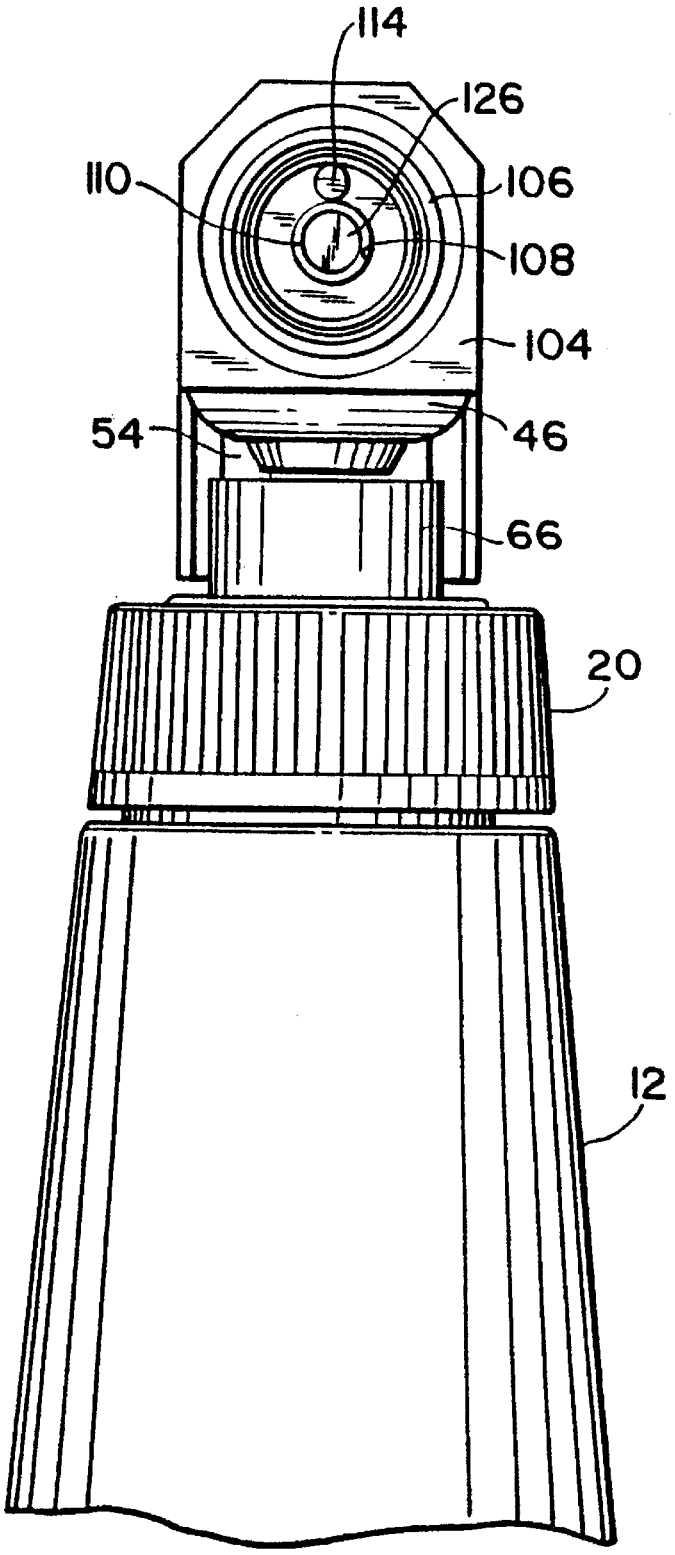
FIG. 4 is a front fragmentary elevational view of the housing mounted on a container and prior to having its front component joined to the housing.

The leg 154 extends rearward and terminates in a shoe 156 which includes an outward rear surface. This extension of the leg serves two functions. It may engage the top of the cap 20 and provides a stop, precluding further outward movement of the lever; that is, it prevents further clockwise rotation of the lever about the hinge 152 much beyond that shown in FIG. 2. This protects the hinge 152 against overstress. Secondly, the shoe 156, when the lever 150 is squeezed against the container 12, will swing up to engage and depress the nose 88 (FIG. 3). This will distort the seal 82 pushing its lip 86 away from engagement with the inside of the wall 64 and permit air to vent inside wall 64, through the aperture 78 slots in lower part 72 and into the container 12.

The operation of the lever has already been partly explained, namely to open the vent to permit air to the container. The more important and well-known purpose of the lever 150 is accomplished as its leg 154 pushes upward on the bottom of the bellows 46 (FIG. 3). This reduces the volume in the bellows and, accordingly, increases pressure in the passage 34 and tube 36.

Because the check valve 75 is seated on the top of upper part 76, there can be no downward escape of pressurized liquid. Thus, the liquid moves past the check disc 126, flexing its perimeter forward. The exiting liquid moves from the enlargement of the opening 108 through the interruption 132*a* and tangentially into the swirl chamber 131 and, swirling ever faster, out the orifice 130 in the form of a spray.

Toward the end of this squeezing stroke of the lever 150 the shoe 156 on the end of the leg 154 depresses nose 88 distorting the seal 82 as described to permit air to vent past the lips 86.

When the lever 150 is subsequently released, the resilience of the bellows 46 restores it to its FIG. 2 shape enlarging the volume of the bellows and drawing liquid up the tube 36. This induces the raising of the check ball 75 (not shown in raising position), drawing liquid up from the container 12. Liquid must be drawn up because the frontal valve disc 126 blocks rearward flow from the frontal area of the housing.

Repetition of the squeezing of the lever 150 toward the container will result in a plurality of successive emissions of liquid product out the orifice 130. The orifice can be restructured if desired so that the emissions are in the form of a foam or stream.

Modification

In the modification disclosed in FIGS. 8–13 the integrally molded front assembly and other features find correspondence with the preferred embodiment discussed above. To point out the parts of the embodiment which are similar to the earlier version, the primed form of a reference number is used in the modification to designate similar elements identified by the same number in the preferred embodiment.

Thus the dispenser 10' in the FIGS. 8–13 embodiment comprises the container 12' having the threaded finish 14' to which is secured the trigger sprayer 16'.

Figure 8:
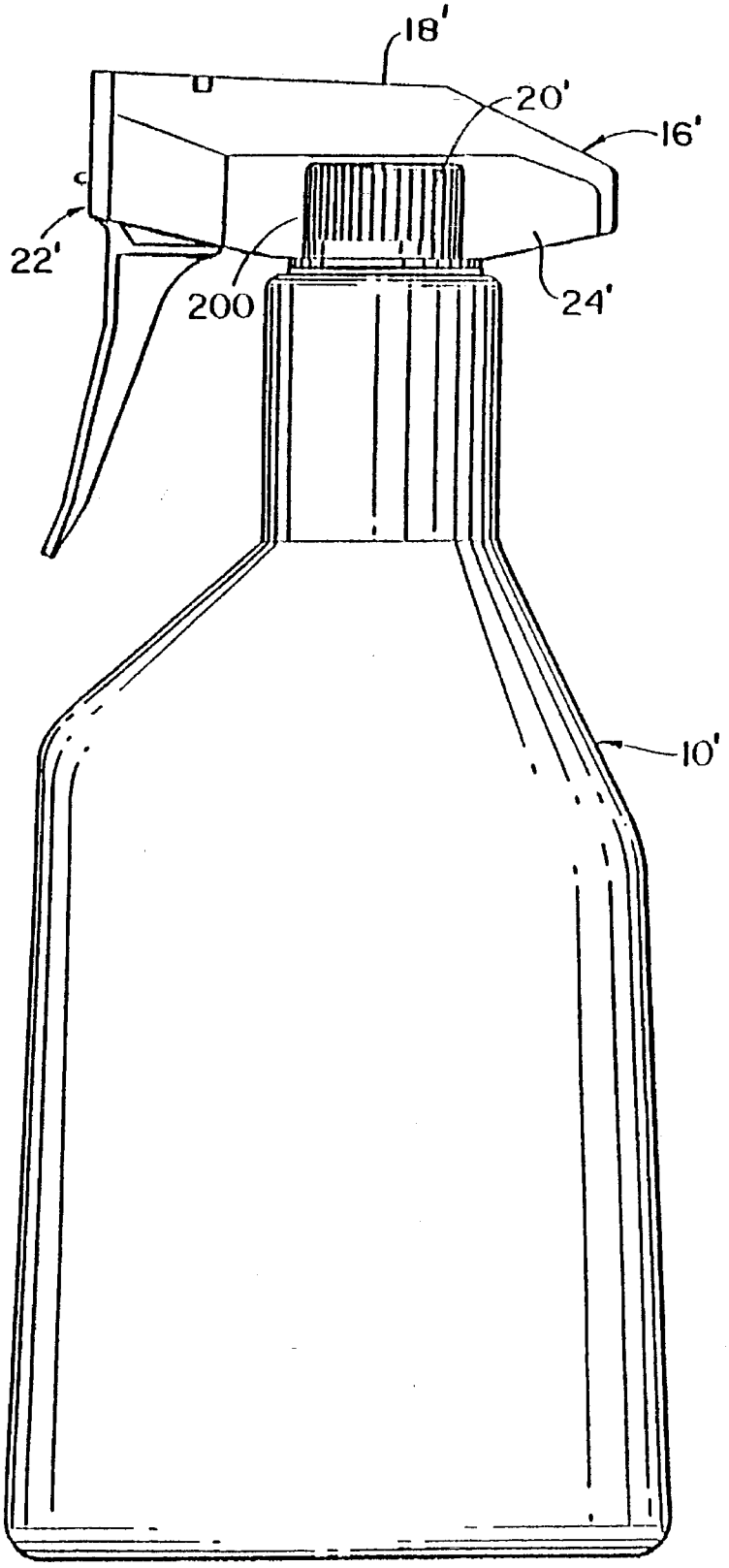
FIG. 8 is an elevational view of a modified form of the invention mounted on a container.

The sprayer 16' comprises a housing 18' secured to the finish by a threaded cap 20'. The integrally molded front component 22' is secured to the discharge or front end of the housing 18'. As shown in FIG. 8, the housing has side wall portions 24' which are notched out as at 200 to make portions of the cap 20' accessible for turning in this low-profile version.

Figure 9:
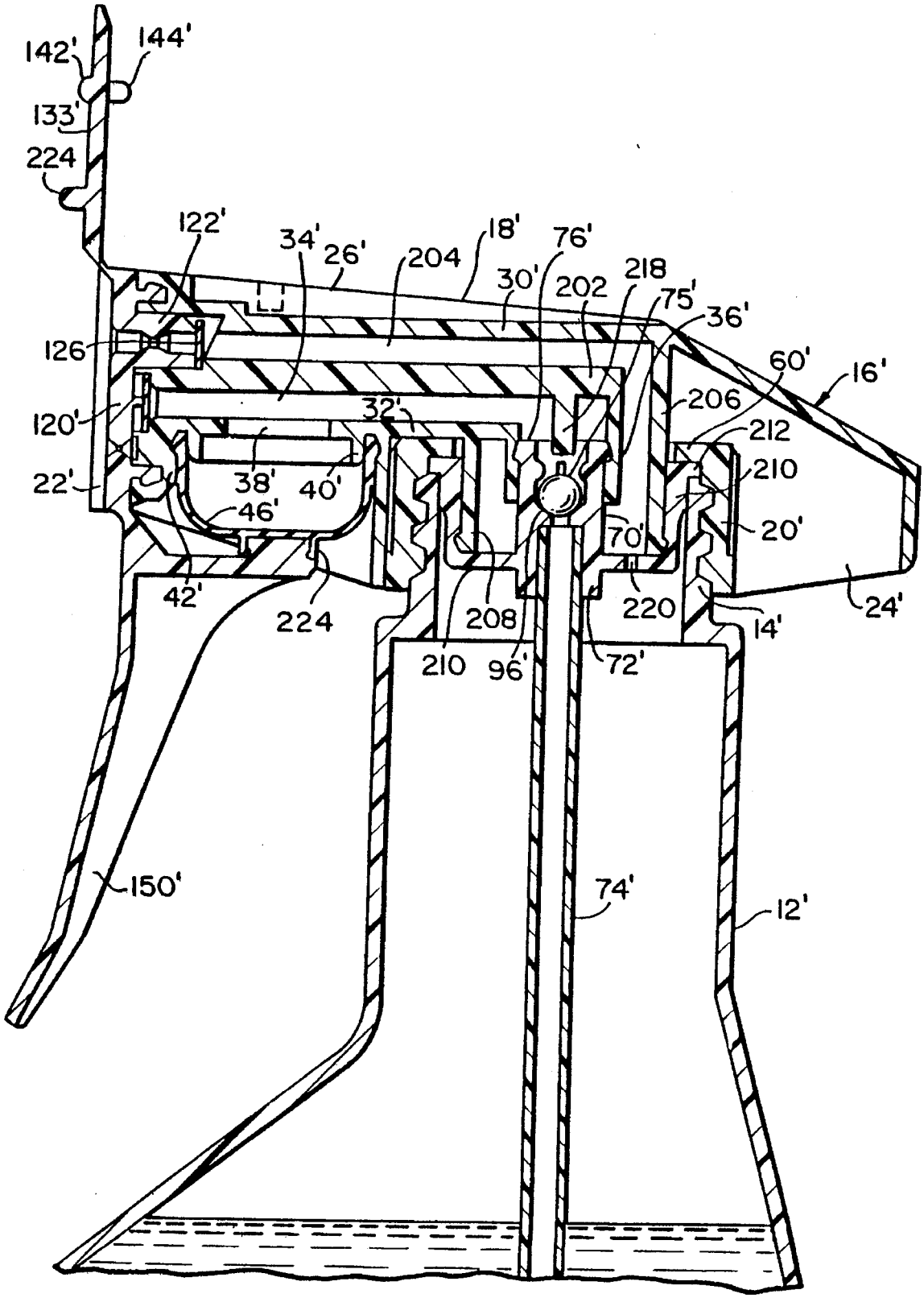
FIG. 9 is an enlarged fragmentary sectional view cutting through the center line of the housing and container of the modified form of the invention.
Figure 10:
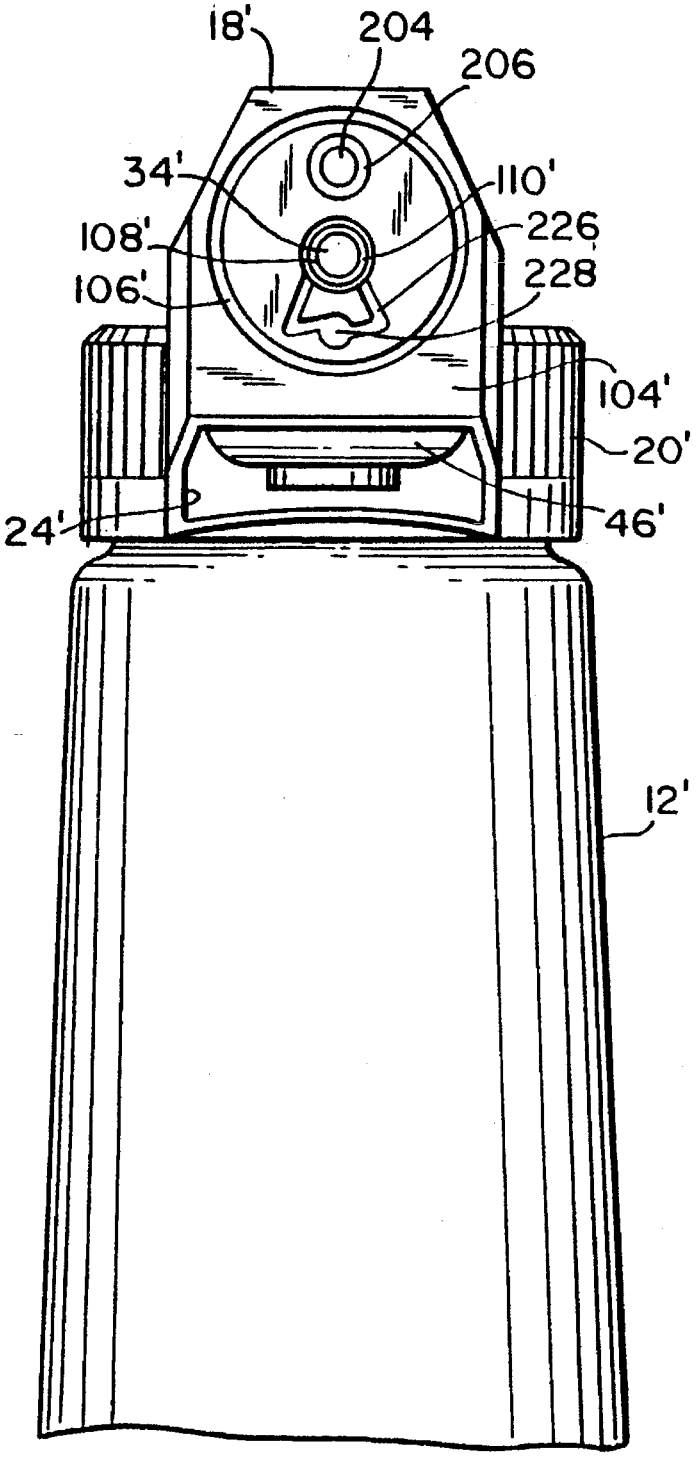
FIG. 10 is a front fragmentary elevational view of the housing of the modified form mounted on a container prior to having its front component joined to the housing.

The housing 18' (FIG. 9) internally presents an integral top wall 26' with lower portion 30', intermediate wall 202 and lower wall 32'. The intermediate wall 202 and lower wall 32' between them form a discharge passage 34' which has a perpendicular enlarged downward extension 36'. The upper wall 30' and the intermediate wall 202 between them form a vent passage 204 which also extends perpendicularly downward in tube 206 which, as shown in FIG. 9, communicates with a downward annular wall 208 concentric with and outward from the downward extension 36'.

A cup-shaped mounting piece 210 is fitted onto the lower end of the annular wall 208. To facilitate this connection, the lower end of the wall 208 may have an outward peripheral nib as shown and the inside surface of the cup-shaped piece 210 may have an undercut as shown, to achieve a snap-type installation.

The cup-shaped piece 210 has an outward flange 212 about its mouth. This flange sits on the top of the finish 14' and is sealingly clamped thereagainst by the partial top wall of the cap 20' to support the housing on the container. The portion of the piece 210 below the flange depends into the neck of the container.

The cup-shaped mounting piece 210 is formed with a central tubular spool or coupling, the upper part 76' of which fits into and mates with the downward extension 36'. These parts may carry nibs and undercuts for snap installation as with the piece 210 and wall 208. Intermediate its ends the coupling 70' is formed with a reduced internal diameter to define a seat 96'. Check ball 75' normally sits on the seat in the upper part 76' and prevents backflow. The ball check may rise with the discharge flow, its upward travel being stopped by the inward nibs as shown in the coupling and the downward stop 218 on the wall 202.

The lower part 72' of the coupling snugly receives and supports the upper end of the dip tube 74'. Offset from the coupling the bottom wall of the cup-shaped piece 210 is apertured in a vent opening as at 220.

The lower wall 32' is formed intermediate the tube 36' and the discharge end of the housing with a large downward opening 38' (FIG. 13) communicating with passage 34'. Surrounding the opening is a downward rim 40' and outside it is a concentric annular wall 42'.

A resilient bowl-shaped bellows 46' is provided and is disposed snugly about the rim 40'. An outward rib on the bowl-shaped bellows fits into an annular groove in the annular wall 42'. A downward ring 224 is formed centrally in the bottom of the bowl-shaped bellows 46' and is undercut.

The housing is formed with a front discharge end wall 104'. The wall 104' (FIGS. 10, 13) is formed with a flat vertical front face, and an annular groove 106' is formed about the opening where the passage 34' emerges in the face. The opening is enlarged at recess 108' to present an annular shoulder 110'. The side wall of the recess 108' join with a pair of channels defining ducts 226 (FIG. 10) which extend outward and downward and thence inward to join tangentially a cylindrical recess defining a breakup or swirl chamber 228.

The annular groove 106' is undercut (FIG. 13) for the purpose of securing to the discharge end the front end component 22'. Assembly 22' comprises the orifice plate 120'. The plate is formed with an integral ring 122' on its rear face. The ring has a peripheral outward rib about its distal end. Within the ring the rear face of the plate 120' is formed with a rearward stud 124' aligned with the opening 108'.

The plate 120' in the modification is also provided with an integral vent nipple 230. The nipple is formed with an axial passage which has a narrow section intermediate its ends. The nipple extends rearward beyond the ring 122'. The front end of the axial passage through nipple 230 may be in the shape of a socket for reasons which will appear.

The vent passage 204 emerges in the front face in an enlarged opening 232 which, in its rear face, is angled as shown. A vent check disc 234 is provided.

In assembly, a resilient discharge check valve disc 126' (FIG. 13) is disposed against the shoulder 110'. Resilient vent check disc 234 is disposed against the rear face opening 232. The front component 22' is maneuvered so that ring 122' is inserted into the annular groove 106 and the nipple fits into opening 232. When the ring 122' snaps into the undercut in the annular groove 106', and the plate is thereby held tight against the end 104', the stud 124' sandwiches the disc 126' between it and the shoulder 110' to form a check valve limiting a flow of liquid backward through the tube 34'. Similarly the vent nipple 230 squeezes a lower portion of the check disc 234 against the bottom of the angled rear face of opening 232.

The plate 120' is additionally formed with an hour-glass-shaped orifice 130' which is aligned with the swirl chamber 228 previously described. The plate 120', when in place, forms the front walls of the enlarged opening 108', ducts 226' and chamber 228'.

The plate 120' has door 133' attached to it by means of an integral "living" hinge 134'. As shown, the front end of the plate 120' is formed with projecting sides 136' (only one shown in FIG. 13) to form a door-receiving recess. The top of the recess is beveled as at 138' and the door is complimentary shaped as at 140'. Further, the door is formed with a sealing bump 142' on the front and a vent-closing head 240 which snaps into the socket in the front of nipple 230 when the door is in closed position. The door 133' has spaced hold-open heads 144' on its rear face.

Figure 11:
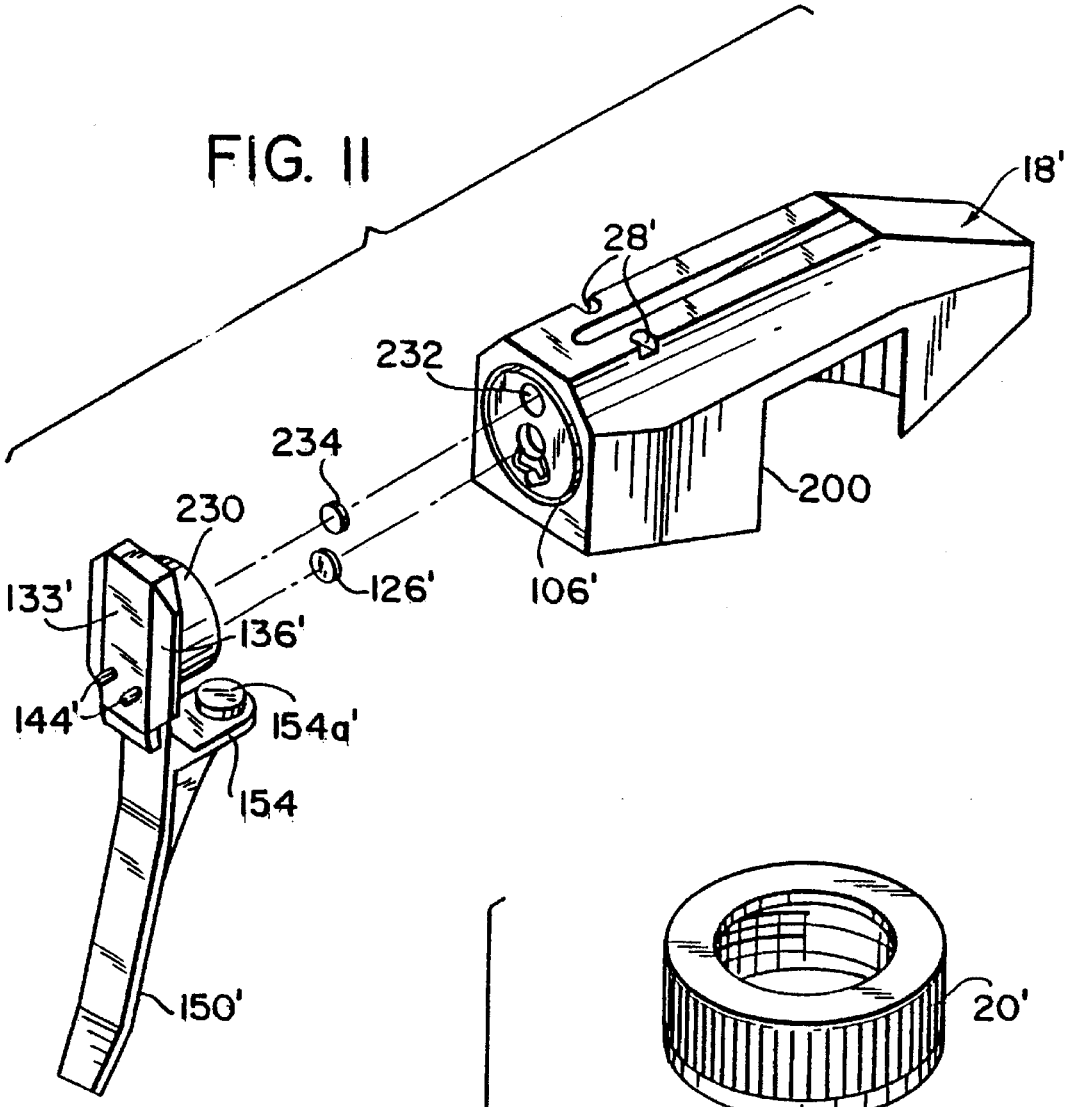
FIG. 11 is an exploded perspective view showing the front component and the housing of the modified form and the vent and orifice valving discs.
Figure 12:
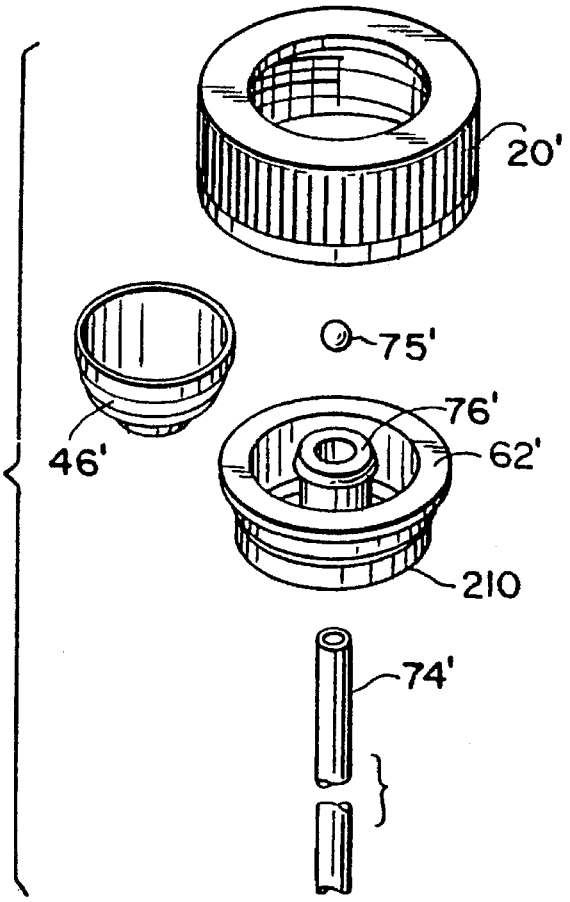
FIG. 12 is a perspective exploded view of the modified form showing various parts of the housing including some of the parts which attach the housing to a container, and the bellows.
Figure 13:
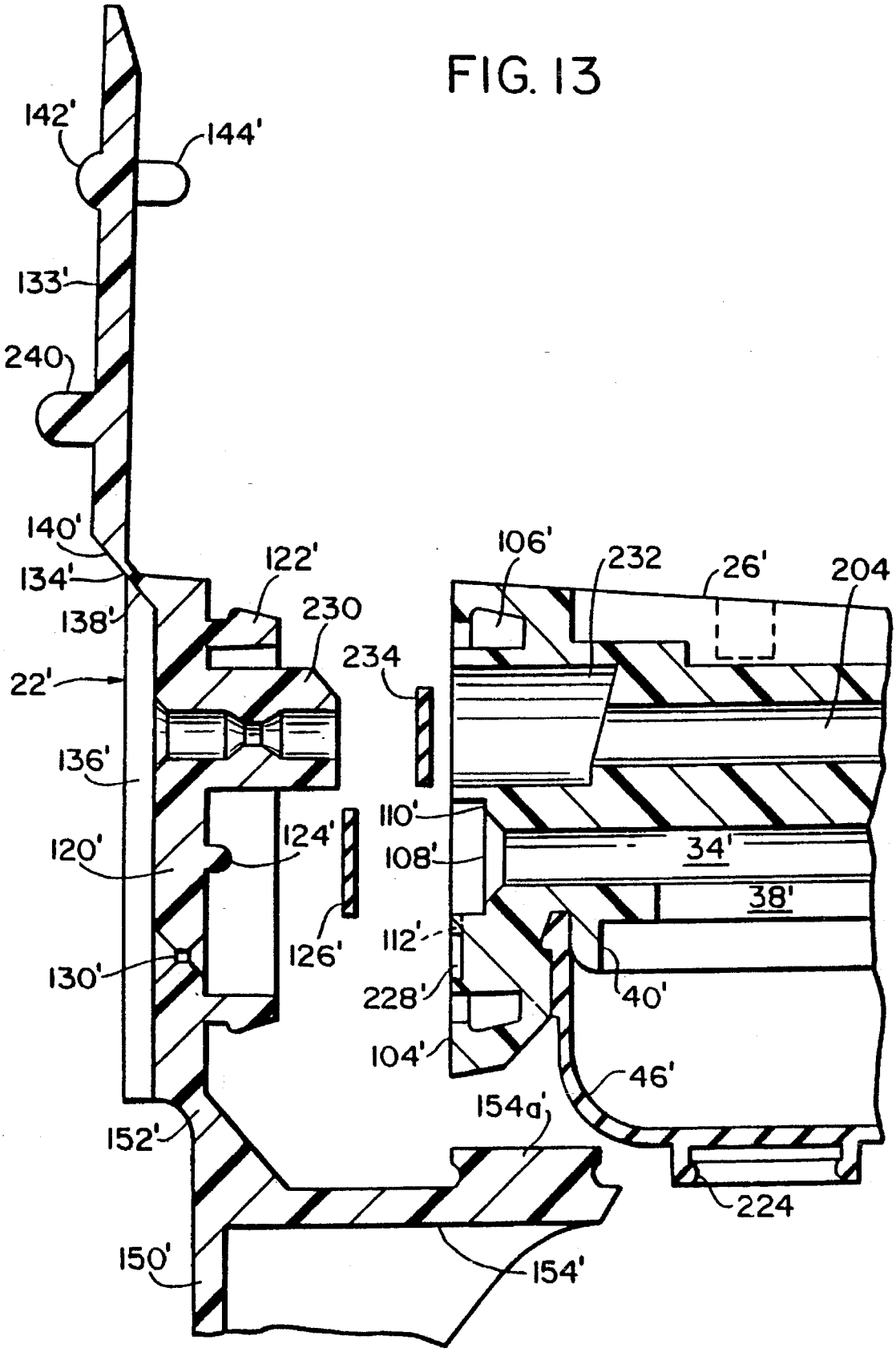
FIG. 13 is a greatly enlarged exploded fragmentary section of the modification showing the front of the housing assembly showing the front end parts prior to assembly.

Thus, the door 133' has two extreme positions. In one, the door 133' may be hinged folded all the way back against the top of the housing so that the head 144' snap into a recesses 28' in the housing (FIG. 11). This holds the door in the open position. In the other, the door 133' may be brought down so that it wedges between the side walls 136' in the door-receiving recess and the head 240 snaps into the socket in the front end of the passage through nipple 230. The sealing bump 142' in this position closes the discharge orifice 130' and seals it.

A third element of the integrally molded front end component 22' is, of course, the trigger lever 150'. The lever is connected to the plate 120' by a second "living" hinge 152'. The lever 150' is formed on its rearward side with a rigid unitary leg 154'. The leg is formed with a mushroom-shaped head **154*a*' which snaps into the undercut ring 224** to secure them together.

The purpose of the lever 150' is accomplished as its leg 154' pushes upward on the bottom of the bellows 46' as the lever is drawn inward. This reduces the volume in the bellows and, accordingly, increases pressure in the passage 34' and tube 36'.

Because the check valve 75' is seated on its seat 96', there can be no downward escape of pressurized liquid. The liquid moves past the check disc 126', flexing its perimeter forward. The exiting liquid moves from the enlargement 108' through the duct arms 112' and tangentally into the swirl chamber 228' and, swirling ever faster, out the central orifice 130' in the form of a spray.

When the lever 150' is subsequently released, the resilience of the bellows 46' restores it to its FIG. 9 position, the bellows enlarging its volume and drawing liquid up the tube 36'. This induces the raising of the check ball 75' (not shown in raised position). Liquid must be drawn up the tube 36' coupling 70' and dip tube 74' because the frontal valve disc 126' blocks rearward flow from the frontal area of the housing.

Repetition of the squeezing of the lever 150' toward the container will result in a plurality of successive emissions of liquid product out the orifice 130'. The orifice can be restructured if desired so that the emissions are in the form of a foam or stream. Vent air will be drawn past the check 234 (FIG. 13) as it pivots rearward and through passages 204, tubes 206 and 208 and opening 220 to equalize inside of the container with the outside.

Second Modification

Figure 14:
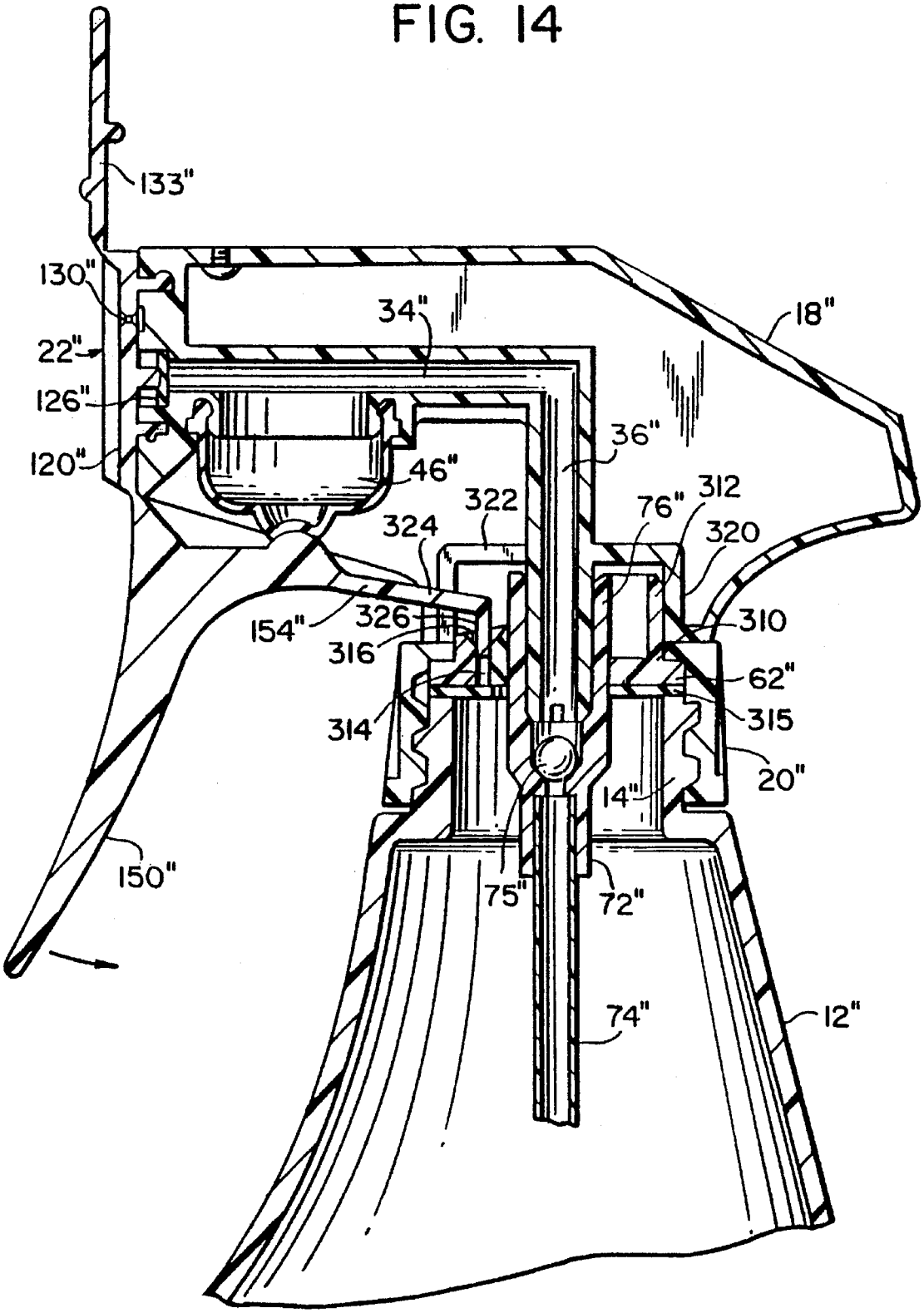
FIG. 14 is a center line sectional view comparable to FIGS. 2 and 9 but of a further modification of the invention featuring different vent means for venting outside air into the container.
Figure 15:
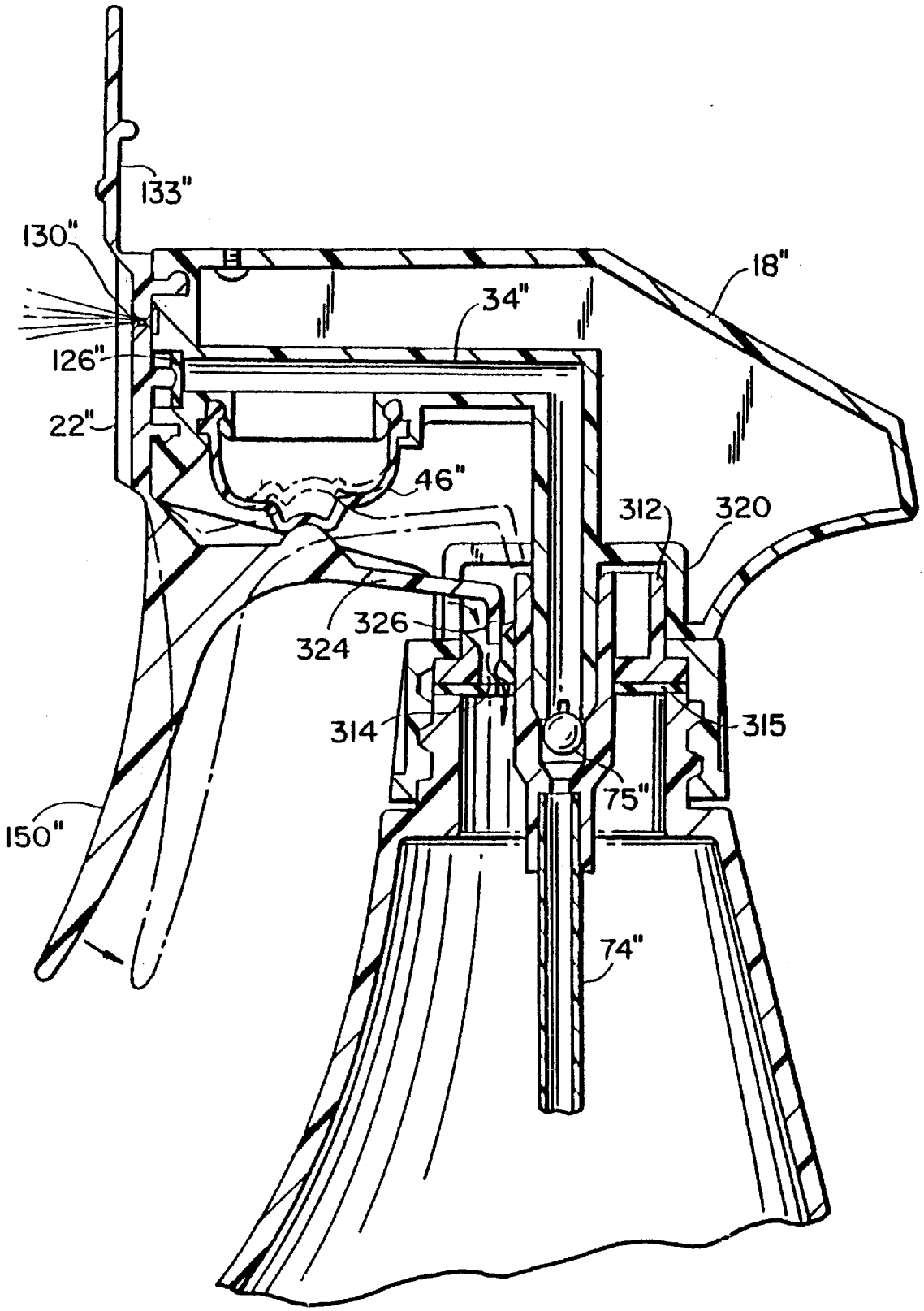
FIG. 15 is a view similar to FIG. 14 but showing the trigger drawn back to work the pump and open the vent.

In the second modification disclosed in FIGS. 14 and 15 many of the parts find correspondence in parts of the earlier embodiments. To emphasize to this, the double primed (") form of a reference numeral is applied to a part which corresponds to the parts identified by the same reference numeral in the earlier embodiments, or the single primed form (') thereof.

Thus, the container 12" has secured to its threaded finish 14" a cap 20". The cap clamps under its partial top wall an outward flange 62" of a collar 310. The collar is formed with a central tubular coupling having an upper part 76" and lower part 72" and an upstanding wall 312 which circumposes the coupling. Toward the discharge end and offset from the coupling the collar is formed with a vent opening 314 extending vertically therethrough. A check flap 315 is clamped between the underside of the collar 310 and the finish 14" and normally covers the vent 314. About the upper end of the opening 314 the collar is formed with a beveled lead-in 316.

The housing 18" is integrally formed within it with a molded tubular passage 34", 36" off of which the bellows pump 46" is mounted. The front end component 22" is provided with a plate 120", a hinged door 133" and a hinged trigger 150". An inverted cup-shaped element 320 surrounds the tube 36", is integral with the housing 18" and is joined to the upward annular wall 312. A portion of the inverted cup-shaped element 320 toward the front end is cut away as at 322 and the leg 154" extends rearward beyond its engagement with the bellows 46" to include an extension 324 which terminates in a downward stopper 326 to selectively plug opening 314.

A check ball arrangement 75" is provided as in earlier embodiments as is the check disc 126" and a connecting passage (not shown) to orifice 130" in plate 120".

In operation, when the lever 150" is drawn toward the container 12" (dotted lines in FIG. 15), the extension 324 lifts the plug 326 from the vent opening 314 to permit air to pass through the opening and past the flexible check flap 315 which flex to permit air passage. When the lever 150" is allowed to return to the position shown in FIG. 14, the vent is sealed closed.

It can be seen that all the embodiments disclose hereabove have the benefit of the integral front assembly comprising the plate, the hinged door and the hinged lever. Not only is such an arrangement economical, it provides the sure alignment of the trigger and the vent leg with the bellows and vent means. Further, the construction enhances the appearance of the unit wherein the vent action is hidden behind the walls in the housing, and checks prevent leakage if the container is upset. Other features discussed above enhance the value of the various embodiments.

Variations in the invention are possible without departing from the spirit of the invention. Thus, while the invention has been shown in only a few embodiments, it is not so limited but is of a scope defined by the following claim language which may be broadened by an extension of the right to exclude others from making or using the invention as is appropriate under the doctrine of equivalents.

What is claimed is:

1. A dispensing pump for attachment to a supply container having a mouth comprising:

a. a pump housing having a discharge end and a mounting end, the mounting end having a downward tubular support body adapted to communicate with and be sealingly secured to the mouth of the container, the support body being formed with a vent opening facing the discharge end, b. tubular seal means disposed about the inside of the tubular support body and normally sealing the vent opening, the seal means being formed with a projection extending through the opening, the projection extending toward the discharge end, c. passage means in the housing extending from an outlet in the discharge end toward the mounting end and into the body and terminating in a downward dip tube inlet means adapted to extend into the container, d. pump means in the housing and connected in the passage means, e. discharge means attached to the pump housing at the discharge end and including an operating lever pivotable toward the support body from an extended position to a retracted position and having a rigid leg adapted to engage and operate the pump means when the lever is pivoted, the leg adapted when the lever is pivoted to the retracted position to laterally engage the projection on the seal means to depress it and break the seal between the seal means and the inside of the tubular body to permit the venting of air into such container.

2. A dispensing pump as claimed in claim 1 wherein the tubular support body includes a threaded element to secure it to the container, the threaded element partly defined by an outward surface which is engaged by the leg to limit the movement of the lever in the extended position.

3. A dispensing pump as claimed in claim 1 wherein the pump means is resilient and biases the lever in the extended position.

4. A dispensing pump as claimed in claim 1 wherein the pump means comprises a resilient bellows and check valve means in the passage means.

5. A dispensing pump as claimed in claim 1 wherein the tubular support body comprises a pair of telescoped overlapping fixed-together elements and the opening extends through both elements where they overlap.

6. A dispensing pump as claimed in claim 1 wherein the seal means is a resilient tubular element having an upper and a lower end, the upper end of which is secured about the inside of the support body above the opening and the lower end of which normally sealingly engages about the support body below the opening.

7. A dispensing pump as claimed in claim 6 wherein the seal means includes a projection integral with the resilient seal and the projection is an outward lug having a beveled nose angled to be closer to the discharge end of the housing at its upper end than at its lower end.

8. A dispensing pump for attachment to a supply container comprising:

a. a pump housing having a discharge end and a mounting end, the mounting end having means for sealingly securing the housing to the mouth of the container, b. a unitary molded discharge end component comprising an orifice plate secured to the housing at the discharge end and having an orifice therein, an orifice door hingedly secured to the plate and adapted to pivot over the orifice to sealingly close it, and an operating lever also hinged to the plate, the lever having a rigid leg extending therefrom toward the mounting end, c. passage means in the housing extending from the discharge end where it communicates with the orifice to the mounting end and terminating in dip tube means adapted to extend into the container, d. pump means in the passage means, operable by the leg as the lever is pivoted, e. vent means in the housing for venting the container to the atmosphere.

9. A dispensing pump as claimed in claim 8 wherein the discharge end of the pump housing has an annular socket and the orifice plate has a front face and a rear face and a ring surrounds the orifice extending rearward from the rear face and the orifice plate is secured to the housing at the discharge end by having the ring fit into the annular socket.

10. A dispensing pump as claimed in claim 8 wherein the pump means comprises a resilient bellows engaged by the leg and check valve means in the passage means.

11. A dispensing pump as claimed in claim 10 wherein the vent means comprises a vent passage separate from the passage means in the housing, the vent passage communicating between means for securing the housing to the container and an opening in the orifice plate separate from the orifice but also sealingly closed by the door.

12. A dispensing pump as claimed in claim 8 wherein the means for securing the housing to the container comprises a tubular support and the vent means comprises an opening in the tubular support having a resilient seal normally closing it from inside the tubular support, the resilient seal having a projection thereon extending through the opening and toward the discharge end, the distal end of the leg engaging the projection to depress it and unseat the seal when the operating lever is pulled toward the tubular support.

13. A dispensing pump as claimed in claim 12 wherein the seal is tubular and has an upper end secured about the inside of the tubular support above the opening and a lower end normally sealingly engaging about the inside of the tubular support below the opening and the projection is integral with the resilient seal and comprises an outward nose angled to be closer to the discharge end of the housing at its upper end than at its lower end.

14. A dispensing pump as claimed in claim 8 wherein the vent means comprises a pluggable vent opening in the means for sealingly securing the housing to the container, the opening communicating between the container and the outside, the container and the leg being provided with an extension having a plug thereon normally closing the vent opening, the plug being removed from the vent opening when the lever is pivoted.

15. A dispensing pump as claimed in claim 14 wherein the vent opening is surrounded with a conical lead-in.

16. A dispensing pump for sealed attachment to a supply container comprising a housing, the housing having a dispensing end and a tubular support body having a vent opening adapted to be sealingly connected to the container, pump means in the housing for drawing liquid from the container and dispensing it out the dispensing end, tubular resilient vent valve means disposed about the tubular support body on the inside thereof to close the opening and having a projection extending outward through the opening, and lever means mounted on the dispensing end and pivotable toward the support body and having a leg adapted to operate the pump means and to engage the projection on the vent valve means from a direction lateral with respect to the vent valve means whereby as the lever means nears the support body, the leg laterally engages the vent valve means and vents the container.

17. A dispensing pump as claimed in claim 16 further including horizontal means on the support body adapted to be engaged by the leg to comprise a stop limiting the travel of the lever means away from the support body.

18. A dispensing pump as claimed in claim 16 wherein the vent valve means is sealingly secured against the body at the end of the valve means more remote from the container and sealingly engages the inside of the support body at its end more proximate the container.

19. A dispensing pump as claimed in claim 16 wherein the housing extends below the level of the vent valve means on opposite sides thereof so that the vent valve means is normally obscured from view.

20. The method of venting a trigger sprayer container having a discharge housing and a tubular support for the housing, the support communicating with the head space of the container and a pivoted lever on the housing, the lever having a leg extending toward the support, the leg adapted to work a bellows-type pump in the housing when the lever is pivoted, the method including:

a. providing a vent opening in the tubular support normally sealed by a tubular seal about the inside of the support and covering the vent, the seal having an integral actuator extending through the opening in a direction toward the lever, and b. extending the lever toward the tubular support so that when the lever is pivoted toward the end of its path closer to the tubular support, the distal end of the leg brushes against the actuator and opens the seal to vent the container.

* * * * *